US007007487B2

(12) United States Patent
Belokon et al.

(10) Patent No.: US 7,007,487 B2
(45) Date of Patent: Mar. 7, 2006

(54) RECUPERATED GAS TURBINE ENGINE SYSTEM AND METHOD EMPLOYING CATALYTIC COMBUSTION

(75) Inventors: Alexander A. Belokon, Moscow (RU); George L. Touchton, Newark, CA (US)

(73) Assignee: MES International, Inc., Asheville, NC (US)

( * ) Notice: Subject to any disclaimer, the term of this patent is extended or adjusted under 35 U.S.C. 154(b) by 0 days.

(21) Appl. No.: 10/631,977

(22) Filed: Jul. 31, 2003

(65) Prior Publication Data

US 2005/0022499 A1 Feb. 3, 2005

(51) Int. Cl.

| | |
|---|---|
| ***F23R 3/34*** | (2006.01) |
| ***F23R 3/40*** | (2006.01) |
| ***F23R 7/10*** | (2006.01) |
| ***F23R 9/28*** | (2006.01) |

(52) U.S. Cl. ..... 60/777; 60/723; 60/39.511; 60/39.52; 60/39.27

(58) Field of Classification Search ..... 60/723, 60/39.511, 39.52, 39.27, 777
See application file for complete search history.

(56) References Cited

U.S. PATENT DOCUMENTS

| | | | | |
|---|---|---|---|---|
| 3,785,145 | A | 1/1974 | Amann | |
| 3,977,182 | A * | 8/1976 | Schroff | 60/39.27 |
| 4,112,675 | A | 9/1978 | Pillsbury et al. | |
| 4,133,171 | A | 1/1979 | Earnest et al. | |
| 4,204,401 | A | 5/1980 | Earnest | |
| 4,271,664 | A | 6/1981 | Earnest | |
| 4,426,842 | A * | 1/1984 | Collet | 60/39.511 |
| 4,754,607 | A | 7/1988 | Mackay | |
| 5,850,731 | A | 12/1998 | Beebe et al. | |
| 6,065,957 | A | 5/2000 | Kondo et al. | |
| 6,105,360 | A | 8/2000 | Willis | |
| 6,107,693 | A * | 8/2000 | Mongia et al. | 290/52 |
| 6,141,953 | A | 11/2000 | Moniga et al. | |
| 6,205,768 | B1 | 3/2001 | Dibble et al. | |
| 6,302,683 | B1 * | 10/2001 | Vestin et al. | 60/723 |
| 6,513,318 | B1 * | 2/2003 | Wright | 60/39.511 |
| 2002/0148227 | A1 | 10/2002 | Mackay | |
| 2002/0152754 | A1 | 10/2002 | Mackay | |
| 2004/0119291 | A1 * | 6/2004 | Hamrin et al. | 290/7 |

FOREIGN PATENT DOCUMENTS

| | | |
|---|---|---|
| EP | 0 686 813 A | 12/1995 |
| JP | 06108879 A | 4/1994 |
| WO | WO 03/029725 A1 | 4/2003 |
| WO | WO 03/036064 A1 | 5/2003 |

OTHER PUBLICATIONS

International Search Report for PCT Application No. PCT/US2004/023589; Filed Jul. 23, 2004; Date of Completion Nov. 9, 2004; Date of Mailing Nov. 17, 2004.

* cited by examiner

*Primary Examiner*—Ted Kim
(74) *Attorney, Agent, or Firm*—Alston & Bird LLP

(57) ABSTRACT

A recuperated gas turbine engine system and associated method employing catalytic combustion, wherein the combustor inlet temperature can be controlled to remain above the minimum required catalyst operating temperature at a wide range of operating conditions from full-load to part-load and from hot-day to cold-day conditions. The fuel is passed through the compressor along with the air and a portion of the exhaust gases from the turbine. The recirculated exhaust gas flow rate is controlled to control combustor inlet temperature.

32 Claims, 4 Drawing Sheets

RECUPERATED GAS TURBINE ENGINE SYSTEM AND METHOD EMPLOYING CATALYTIC COMBUSTION

FIELD OF THE INVENTION

The invention relates to recuperated gas turbine engine systems in which catalytic combustion is employed.

BACKGROUND OF THE INVENTION

The use of catalytic processes for combustion or oxidation is a well-known method for potentially reducing levels of nitrogen oxides ($NO_x$) emissions from gas turbine engine systems. There are various processes for converting the chemical energy in a fuel to heat energy in the products of the conversion. The primary processes are: 1) gas phase combustion, 2) catalytic combustion, and 3) catalytic oxidation. There are also combinations of these processes, such as processes having a first stage of catalytic oxidation followed by a gas phase combustion process (often referred to as cata-thermal). In catalytic oxidation, an air-fuel mixture is oxidized in the presence of a catalyst. In all catalytic processes the catalyst allows the temperature at which oxidation takes place to be reduced relative to non-catalytic combustion temperatures. Lower oxidation temperature leads to reduced $NO_x$ production. In catalytic oxidation all reactions take place on the catalytic surface; there are no local high temperatures and therefore the lowest possible potential for $NO_x$ to be formed. In either catalytic combustion or catathermal combustion, some part of the reaction takes place in the gas phase, which increases local temperatures and leads to higher potential for $NO_x$ being formed. Using catalytic oxidation, $NO_x$ levels less than one part per million can be achieved under optimum catalytic oxidation conditions; such low levels in general cannot be achieved with conventional non-catalytic combustors, catalytic combustion, or cata-thermal combustion. In the present application, the term "catalytic combustor" is used to refer to any combustor utilizing catalysis, preferably one utilizing catalytic oxidation.

The catalyst employed in a catalytic combustor tends to operate best under certain temperature conditions. In particular, there is typically a minimum temperature below which a given catalyst will not function. For instance, palladium catalyst requires a combustor inlet temperature for the air-fuel mixture higher than 800 K when natural gas is the fuel. In addition, catalytic oxidation has the disadvantage that the physical reaction surface which must be supplied for complete oxidation of the hydrocarbon fuel increases exponentially with decreasing combustor inlet temperatures, which greatly increases the cost of the combustor and complicates the overall design. The need for a relatively high combustor inlet temperature is one of the chief reasons why catalytic combustion in general, and catalytic oxidation in particular, has not achieved widespread use in gas turbine engine systems. More specifically, such high combustor inlet temperatures generally cannot be achieved in gas turbines operating with compressor pressure ratios less than about 40 unless a recuperated cycle is employed. In a recuperated cycle, the air-fuel mixture is pre-heated, prior to combustion, by heat exchange with the turbine exhaust gases. Recuperation thus can help achieve the needed combustor inlet temperature for proper catalyst operation, at least under some conditions. However, there are often other operating conditions that will be encountered at which the minimum required combustor inlet temperature still cannot be achieved even with recuperation.

For instance, when recuperation is applied in small gas turbines, material temperature limitations in the recuperator can limit the maximum air or air-fuel mixture temperature. As an example, with conventional high-temperature materials in the recuperator, the maximum safe operating temperature of the recuperator may be about 900 K, and hence an air-fuel mixture temperature of about 800 to 850 K is about the highest that can be achieved. This temperature range is higher than the minimum catalyst operating temperature for some types of catalysts and therefore the catalytic combustor may operate properly at one particular operating condition such as 100 percent load and standard-day ambient conditions. At other operating conditions, however, such as part-load and/or cold ambient conditions, the combustor inlet temperature may fall below the minimum.

It would be desirable to be able to overcome such problems so that the low-$NO_x$ potential of catalytic oxidation could be realized in small gas turbine engine systems. Additionally, there are other benefits that can be achieved with catalytic processes. These processes extend the operating flammability limits of gaseous hydrocarbon fuels, including but not limited to landfill gases, anaerobic digester gases, natural gas, and methane. Thus, the process can take place at much more dilute (leaner) fuel/air ratios than conventional combustion. This allows the fuel gas to be mixed with the air prior to or during the compression process, resulting in a uniform fuel-air mixture entering the combustor. This in turn allows the elimination of a fuel gas compressor, which is very costly particularly for small gas turbines. Fuel gas compressors may add \$60/kW or more to the cost of the engine, which is typically in the range of \$600–\$900/kW. Furthermore, the fuel gas compressor detracts from the reliability and availability of the engine, since it must operate in order for the engine to operate, and adds to the cost of maintenance because of oil, filters, mechanical or electrical wear out, and the like.

SUMMARY OF THE INVENTION

The present invention addresses the above needs and achieves other advantages, by providing a recuperated gas turbine engine system and associated method employing catalytic oxidation or combustion or cata-thermal combustion, wherein the combustor inlet temperature can be controlled to remain above the minimum required catalyst operating temperature, and further optimized as a function of fuel/air ratio, at a wide range of operating conditions from full-load to part-load and from hot-day to cold-day conditions.

In accordance with a method aspect of the invention, a method for operating a gas turbine engine comprises steps of compressing air in a compressor, mixing fuel with compressed air from the compressor to produce an air-fuel mixture, burning the air-fuel mixture in a catalytic combustor to produce hot combustion gases, expanding the combustion gases in a turbine to produce mechanical power and using the mechanical power to drive the compressor, and passing exhaust gases from the turbine through a recuperator in which the air-fuel mixture is pre-heated by heat exchange with the exhaust gases. The method includes the further step of directing a portion of exhaust gases from the turbine into the compressor. The fuel is also passed through the compressor along with the air and the portion of exhaust gases. The recirculation of the exhaust gas raises the inlet temperature to the combustor above what it would be without the exhaust gas recirculation. Ultimately what enters the combustor is a mixture of the air, fuel, and exhaust gases optimized to meet power output, maximize efficiency, and minimize air pollution The mixing of the air, fuel, and exhaust gases can be accomplished in various ways. In one embodiment, mixing of the exhaust gases with the fuel is accomplished upstream of the compressor, and the mixed exhaust gases and fuel are directed into the compressor separately from the air. Alternatively, at least some mixing of the fuel with the air can be accomplished upstream of the compressor, and the mixed fuel and air can be directed into the compressor separately from the exhaust gases. As yet another alternative, the air, fuel, and exhaust gases are directed into the compressor separately from one another and mixing takes place in the compressor or passages associated with the compressor and other components.

In accordance with the invention, the flow rate of the exhaust gases directed into the compressor is controlled in response to one or more parameters associated with the engine, at least one of which is the fuel/air ratio. For instance, the controlling step can comprise controlling the flow rate in response to a measured combustor inlet temperature so as to maintain the combustor inlet temperature higher than a predetermined minimum temperature necessary for proper operation of the catalytic combustor at that fuel/air ratio. In this manner, the flow rate of the exhausts gases into the compressor can be optimized to compensate for changes in ambient temperature and/or relative engine load.

The portion of exhaust gases directed into the compressor can be separated from the remainder of the exhaust gases at a point downstream of the recuperator. In this case, the recirculated exhaust gases will be reduced in temperature by their passage through the recuperator. Alternatively, the portion of exhaust gases directed into the compressor can be separated from the remainder of the exhaust gases at a point upstream of the recuperator such that the recirculated exhaust gases bypass the recuperator. In such an arrangement, the temperature of the recirculated exhaust gases fed to the compressor will be higher and therefore the recirculated exhaust gas flow rate can be lower than in the previously described arrangement.

A recuperated gas turbine engine system employing catalytic combustion in accordance with the invention comprises a compressor arranged to receive air and to compress the air, a fuel system operable to supply fuel into the compressor such that a mixture of compressed air and fuel is discharged from the compressor, a catalytic combustor operable to combust the mixture to produce hot combustion gases, a turbine arranged to receive the combustion gases and expand the gases to produce mechanical power that drives the compressor, a recuperator arranged to receive exhaust gases from the turbine and the mixture discharged from the compressor and cause heat exchange therebetween such that the mixture is pre-heated before entering the catalytic combustor, and a recirculation system operable to direct a portion of turbine exhaust gases into the compressor, such that the mixture discharged from the compressor is raised in temperature by the exhaust gases, whereby an inlet temperature to the catalytic combustor is raised.

The recirculation system can include a valve that is controllable to variably adjust a flow rate of the exhaust gases into the compressor, and a control system operably connected to the valve. Sensors operable to measure parameters indicative of fuel/air ratio and combustor inlet temperature can be connected to the control system, and the control system can be operable to control the valve in a manner to cause the combustor inlet temperature to exceed a predetermined minimum temperature necessary for proper operation of the catalytic combustor and to match an optimal temperature for the measured fuel/air ratio. As noted, the valve can be upstream or downstream of the recuperator.

The recuperated engine system in accordance with the invention has utility in various applications, including small electrical power generation systems. Thus, an electrical generator can be arranged to be driven by the turbine.

The system is not limited to single-spool turbine engines, but can also be applied to multiple-spool engines or ganged systems of single-spool engines.

The benefits of the present system and method will be greatest for catalytic oxidation processes, but all processes employing catalysis will benefit.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
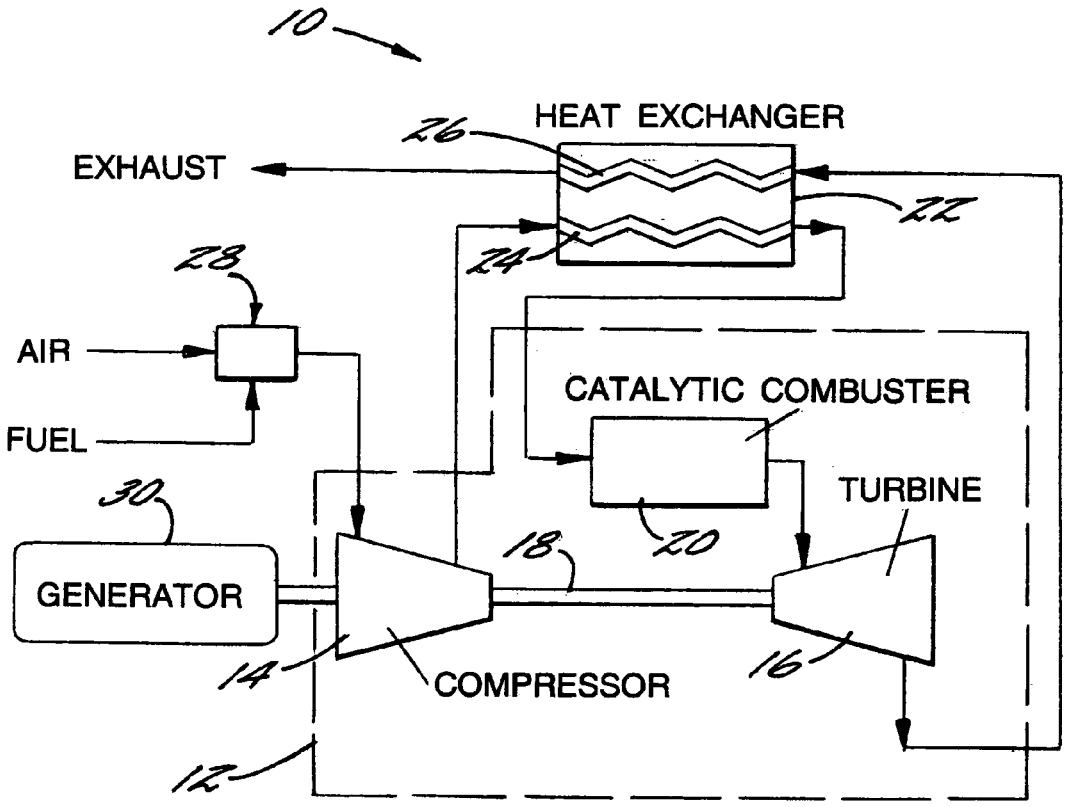
FIG. 1. (PRIOR ART)
FIG. 1 is a diagrammatic depiction of a turbine engine system in accordance with the prior art.

A prior-art electrical generation system 10 driven by a recuperated gas turbine engine with catalytic combustion is shown in FIG. 1. The system includes a gas turbine engine 12 comprising a compressor 14 and a turbine 16 connected by a shaft 18 so as to drive the compressor, and a catalytic combustor 20. The system also includes a heat exchanger or recuperator 22 having one or more passages 24 for compressor discharge fluid, arranged in heat-transfer relationship with one or more passages 26 for turbine exhaust gas. The system further includes an arrangement 28 for bringing together and mixing air and fuel and feeding the mixture into the compressor 14.

The compressed air-fuel mixture is pre-heated in the recuperator 22 and is then fed into the catalytic combustor 20 where combustion takes place. The hot combustion gases are led from the combustor into the turbine 16, which expands the hot gases to produce mechanical power, which power is transmitted by the shaft 18 to the compressor 16. Also linked to the shaft is an electrical generator 30, which is driven to produce electrical current for supply to a load.

Figure 4:
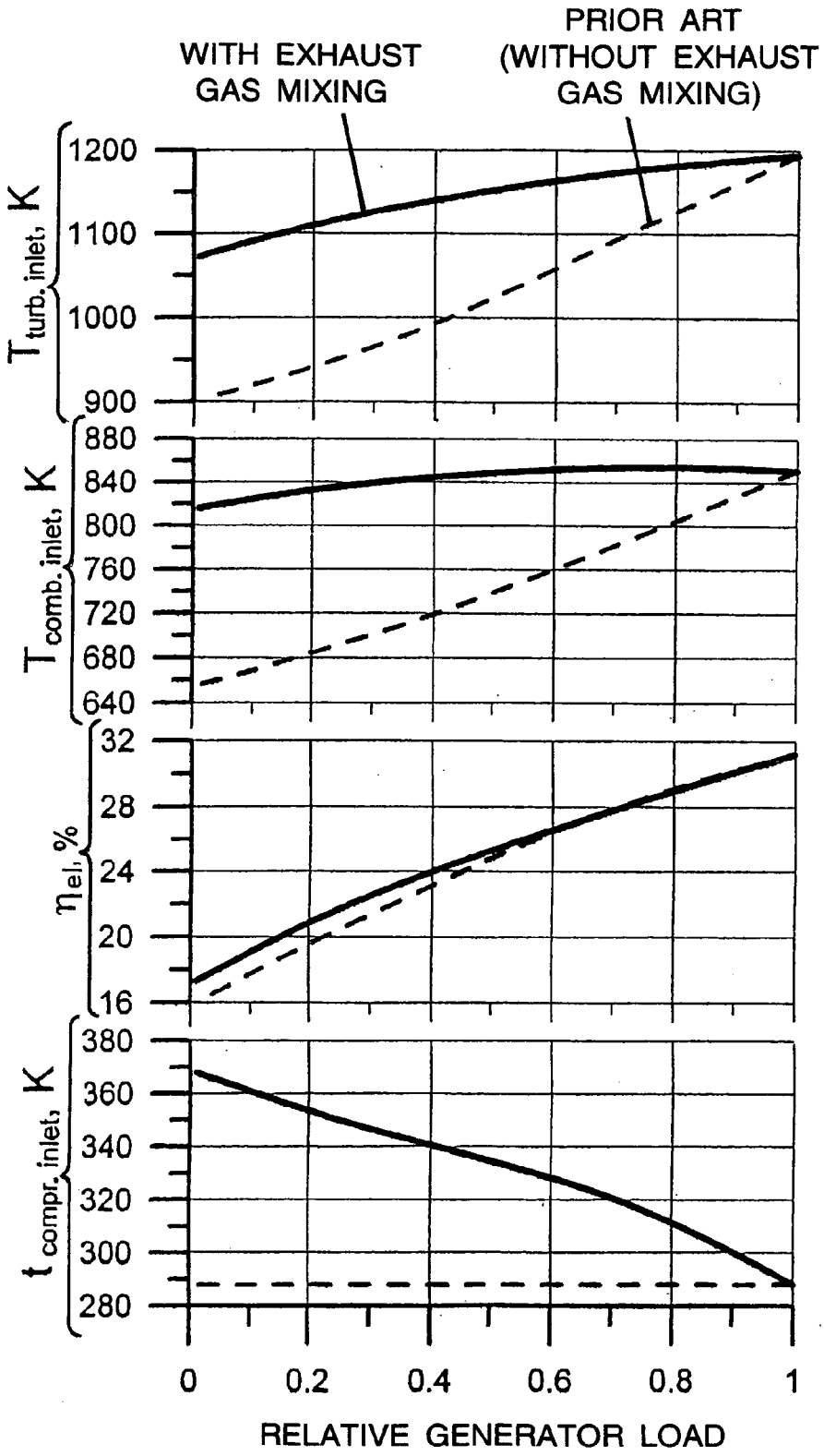
FIG. 4 is a graph showing model calculations of turbine inlet temperature, combustor inlet temperature, efficiency, and compressor inlet temperature as a function of relative load, for both a prior-art turbine engine system without exhaust gas mixing at the compressor inlet, and a turbine engine system in accordance with the invention having exhaust gas mixing at the compressor inlet.

In a system such as shown in FIG. 1, it is possible to design the engine components such that at relatively high engine loads and standard-day conditions, the temperature of the air-fuel mixture fed into the catalytic combustor 20 is at or above the catalyst minimum temperature required for proper operation of the catalytic reaction. The most widely used palladium catalyst requires a combustor inlet temperature of at least 800 K. At low loads and/or cold ambient conditions, however, the combustor inlet temperature can fall below the catalyst minimum. See the dashed lines in FIG. 4, representing model calculations of various thermodynamic variables as a function of relative load, for the prior-art type of cycle shown in FIG. 1. At a 100% load condition, the combustor inlet temperature is about 850 K, but drops to the catalyst minimum of 800 K at about 80% load. At still lower loads, the combustor inlet temperature is too low to support proper operation of the catalytic combustor.

Figure 2:
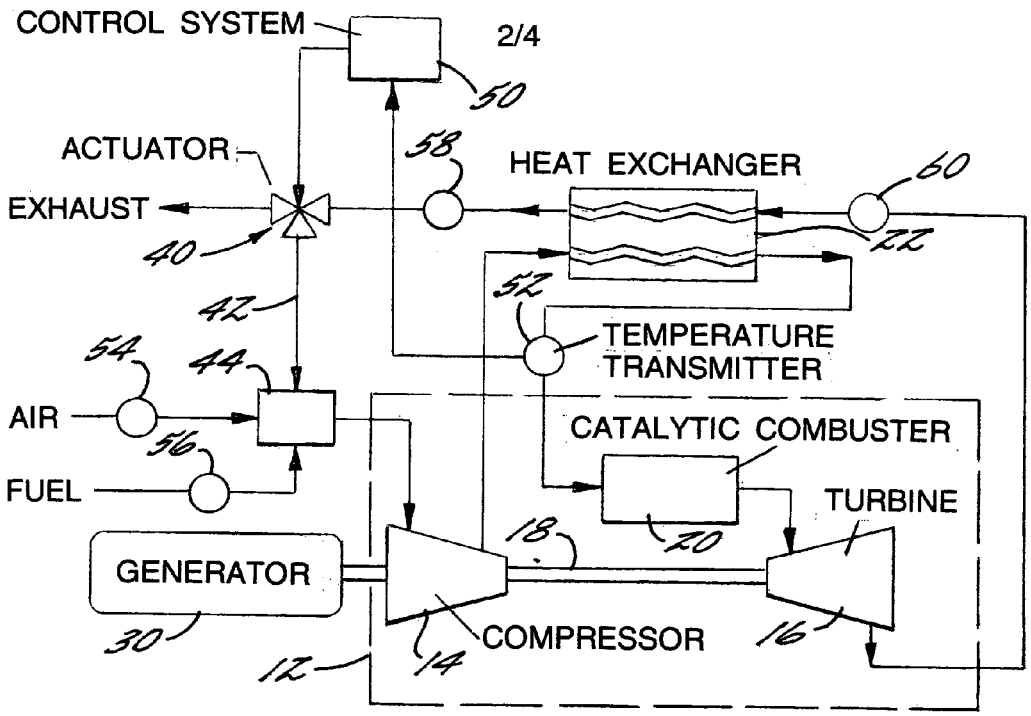
FIG. 2 is a diagrammatic depiction of a turbine engine system in accordance with a first embodiment of the invention.

The present invention provides a gas turbine engine system and method that overcome this problem. FIG. 2 shows an electrical generator system driven by a turbine engine system in accordance with a first embodiment of the invention. A generator 30 is driven by a turbine engine 12 having a compressor 14, turbine 16, shaft 18, and catalytic combustor 20 as previously described. A recuperator 22 is employed for pre-heating the air-fuel mixture before its introduction into the combustor, as previously described.

However, the combustor inlet temperature is regulated by the introduction of a portion of the turbine exhaust gas into the compressor. The exhaust gas has a substantially higher temperature than the ambient air entering the compressor, and therefore serves to boost the temperature of the fluid passing through the compressor, which in turn boosts the combustor inlet temperature.

Thus, the system includes an actuatable valve 40 disposed downstream of the recuperator 22 for diverting a portion of the turbine exhaust gas through a line 42 to a mixer 44. The mixer 44 also receives at least two of air, fuel, and exhaust and mixes at least two of the three constituents at least partially. The mixture is then fed into the compressor 14, where further mixing may occur. Any third unmixed stream may be introduced into the compressor simultaneously with the other two and mixed therein or in subsequent passages before reaching the recuperator.

The valve 40 is operable to selectively vary the amount of turbine exhaust gas delivered through the line 42 to the mixer 44. Additionally, the valve is controllable by a control system 50 (which may be a PC, a PLC, a neural network, or the like) that is responsive to a temperature signal from a temperature sensor 52 arranged for detecting the combustor inlet temperature. The control system can also be responsive to an airflow signal from an airflow sensor 54 arranged for detecting the air flow rate, and a fuel flow signal from a fuel flow sensor 56 arranged for detecting fuel flow rate. Sensors 58 for detecting emissions, particularly unburned hydrocarbons, can also be arranged in the exhaust duct after the recuperator, if desired, and the measured emissions can be taken into account by the control system. Alternatively, the emissions may be calculated from the combustor inlet temperature and fuel/air ratio using models determined from theory and engine testing. Additionally, a sensor 60 for measuring recuperator inlet temperature can also be employed. Although the connecting lines between the sensors 54, 56, 58, and 60 and the control system 50 are not shown in FIGS. 2 and 3, it will be understood that these sensors are connected to the control system. The control system is suitably programmed to control the operation of the valve 40 so as to regulate the combustor inlet temperature as desired. In particular, the control system preferably includes logic for open-loop or closed-loop control of the valve 40 in such a manner that the combustor inlet temperature always equals or exceeds a predetermined minimum temperature necessary for proper catalytic reaction in the combustor. Advantageously, the control is also carried out so that the recuperator inlet temperature does not exceed the maximum allowable recuperator inlet temperature, preferably while simultaneously minimizing emissions (or maintaining them below desired limits) and maximizing efficiency. Generally, as load drops, the proportion of turbine exhaust gas that must be fed back into the compressor will increase so as to maintain combustor inlet temperature above the predetermined minimum level.

The effect of exhaust gas mixing with the air and fuel is shown in solid lines on FIG. 4. As load drops, the compressor inlet temperature increases, reflecting the greater and greater proportion of exhaust gas being recirculated to the compressor. As a result, the combustor inlet temperature is maintained above 800 K for all load conditions. At the same time, in preferred embodiments, the recuperator inlet temperature is prevented from exceeding its maximum allowable value at all operating conditions, and the efficiency of the engine is optimized, via simultaneous control of the recirculated exhaust gas flow rate and fuel/air ratio.

It will be appreciated that the same system and method can compensate for changing ambient temperature. Thus, as ambient temperature decreases, the proportion of recirculated exhaust gas can be increased, if necessary, to maintain the needed combustor inlet temperature. The combined effects of changing load and ambient temperature can also be compensated for by the system and method of the invention.

Figure 3:
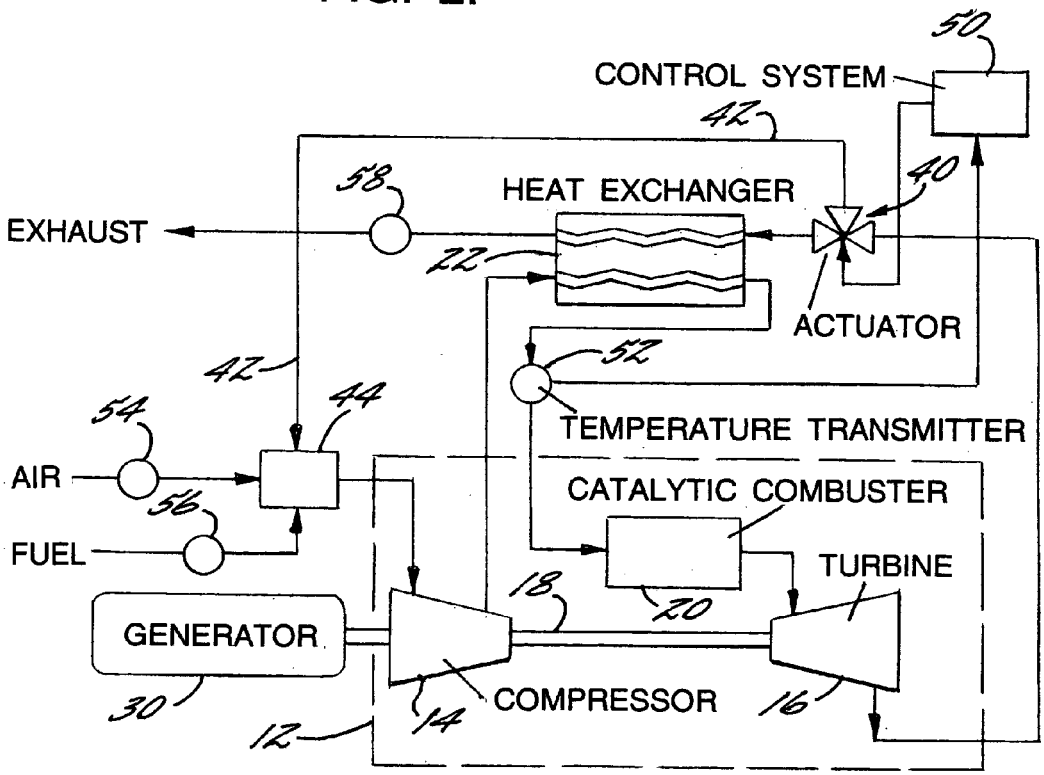
FIG. 3 is a diagrammatic depiction of a turbine engine system in accordance with a second embodiment of the invention.

FIG. 3 shows a second embodiment of the invention, generally similar to that of FIG. 2, except the valve 40 is located upstream of the recuperator 22 instead of downstream. The line 42 thus bypasses the recuperator, so the exhaust gas is not cooled in the recuperator before being recirculated. Because the temperature of the recirculated exhaust gas is higher, the relative proportion of exhaust gas that must be recirculated is lower than for the embodiment of FIG. 2, all other factors being equal. In other respects, the operation of this system is the same as that of FIG. 2.

Figure 5A:
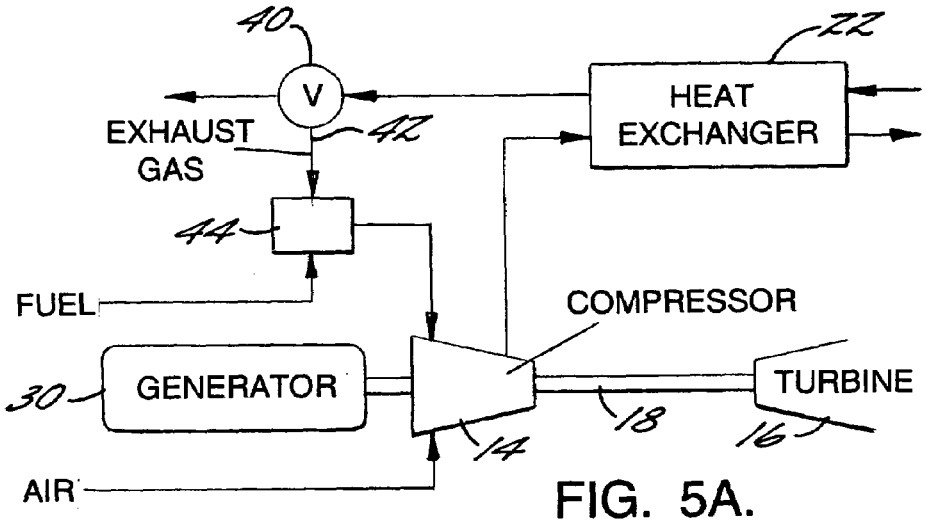
FIG. 5A depicts another embodiment of the invention in which fuel and exhaust gas are mixed and fed into the compressor separate from the air, such that mixing with air takes place entirely in the compressor.
Figure 5B:
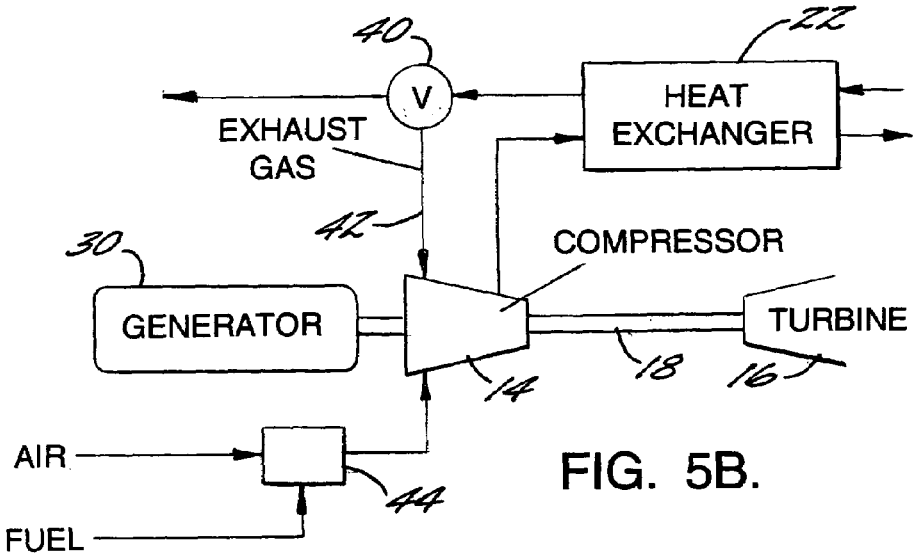
FIG. 5B shows a further embodiment in which the air and fuel are mixed before being fed into the compressor, and the exhaust gas is separately fed into the compressor.
Figure 5C:
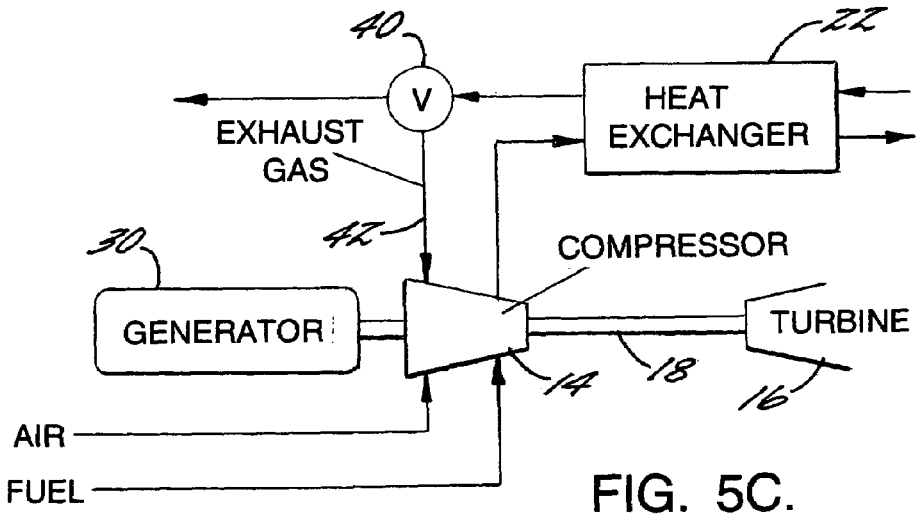
FIG. 5C shows yet another embodiment in which the air, fuel, and exhaust gas are all separately fed into the compressor where they are mixed.

The manner in which the exhaust gas is recirculated and mixed with the air and fuel can be varied in the practice of the invention. FIGS. 5A–C show several possibilities, although they are not exhaustive, and other variations can be used. All of these examples are based on the valve 40 being downstream of the recuperator 22, but they apply equally to systems in which the valve is upstream of the recuperator. In the embodiment of FIG. 5A, the recirculated exhaust gas is mixed with fuel in the mixer 44, and the resulting mixture is fed into the compressor 14 separately from the air. This arrangement may be advantageous when the fuel is initially in liquid form (e.g., propane) in that the hot exhaust gas will vaporize at least part of the fuel before it is fed into the compressor.

In the arrangement of FIG. 5B, air and fuel are mixed in the mixer 44 and the resulting mixture is fed into the compressor. The exhaust gas from the line 42 is fed into the compressor separately, and mixing with the air and fuel occurs in the compressor.

Yet another possibility is shown in FIG. 5C, where the air, fuel, and exhaust gas are all fed separately into the compressor, and mixing between all three occurs in the compressor.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A recuperated gas turbine engine system employing catalytic combustion, comprising:

a compressor arranged to receive air and to compress the air;

a fuel system operable to supply fuel into the compressor, such that a mixture of compressed air and fuel is discharged from the compressor;

a catalytic combustor operable to combust the mixture to produce hot combustion gases;

a turbine arranged to receive the combustion gases and expand the gases to produce mechanical power that drives the compressor;

a recuperator arranged to receive exhaust gases from the turbine and the mixture discharged from the compressor and cause heat exchange therebetween such that the mixture is pre-heated before entering the catalytic combustor; and a system operable to direct a portion of turbine exhaust gases into the compressor during part-load and near full-load operation of the gas turbine engine, such that the mixture discharged from the compressor is raised in temperature by said exhaust gases, whereby an inlet temperature to the catalytic combustor is raised, wherein said system comprises a valve that is controllable to variably adjust a flow rate of the exhaust gases into the compressor, and a control system operably connected to the valve.

2. The recuperated gas turbine engine system of claim 1, wherein the control system includes a sensor operable to measure a parameter indicative of combustor inlet temperature, the control system being operable to control the valve in a manner to cause the combustor inlet temperature to exceed a predetermined minimum temperature necessary for proper operation of the catalytic combustor.

3. The recuperated gas turbine engine system of claim 1, wherein the valve is located downstream of the recuperator such that the exhaust gases are cooled in the recuperator before being directed into the compressor.

4. The recuperated gas turbine engine system of claim 1, wherein the valve is located upstream of the recuperator such that the portion of exhaust gas bypasses the recuperator and is then directed into the compressor.

5. The recuperated gas turbine engine system of claim 1, further comprising an electrical generator arranged to be driven by the turbine.

6. A recuperated gas turbine engine system employing catalytic combustion, comprising:

a compressor arranged to receive air and to compress the air;

a fuel system operable to supply fuel into the compressor, such that a mixture of compressed air and fuel is discharged from the compressor;

a catalytic combustor operable to combust the mixture to produce hot combustion gases;

a turbine arranged to receive the combustion gases and expand the gases to produce mechanical power that drives the compressor;

a recuperator arranged to receive exhaust gases from the turbine and the mixture discharged from the compressor and cause heat exchange therebetween such that the mixture is pre-heated before entering the catalytic combustor; and a system operable to direct a portion of turbine exhaust gases into the compressor, such that the mixture discharged from the compressor is raised in temperature by said exhaust gases, whereby an inlet temperature to the catalytic combustor is raised, wherein said system comprises a valve that is controllable to variably adjust a flow rate of the exhaust gases into the compressor, and a control system operably connected to the valve, the control system including a sensor operable to measure a parameter indicative of combustor inlet temperature, the control system being operable to control the valve in a manner to cause the combustor inlet temperature to exceed a predetermined minimum temperature necessary for proper operation of the catalytic combustor, wherein the control system further comprises a sensor operable to measure air flow rate and a sensor operable to measure fuel flow rate, and a sensor operable to measure recuperator inlet temperature, the control system operable to determine fuel/air ratio of the mixture entering the combustor based on the flow rates of air, fuel, and exhaust gases, and to control the flow rate of exhaust gases into the compressor so as to optimize the combustor inlet temperature for said fuel/air ratio in such a manner that a maximum allowable recuperator temperature is not exceeded.

7. The recuperated gas turbine engine system of claim 6, wherein the control system is further operable to control the combustor inlet temperature for said fuel/air ratio in such a manner that an efficiency of the engine is maximized.

8. The recuperated gas turbine engine system of claim 7, further comprising means for determining a level of emissions from the engine, and wherein the control system is operable to control the combustor inlet temperature for said fuel/air ratio in such a manner that a maximum allowable emissions limit is not exceeded.

9. The recuperated gas turbine engine system of claim 8, wherein the means for determining a level of emissions comprises an emissions sensor.

10. The recuperated gas turbine engine system of claim 7, further comprising means for determining a level of emissions from the engine, and wherein the control system is operable to control the combustor inlet temperature for said fuel/air ratio in such a manner that emissions are minimized.

11. A method for operating a gas turbine engine at part-load and full-load operating conditions, comprising the steps of:

compressing air in a compressor;

mixing fuel with compressed air from the compressor to produce an air-fuel mixture;

burning the air-fuel mixture in a catalytic combustor to produce hot combustion gases;

expanding the combustion gases in a turbine to produce mechanical power, and using the mechanical power to drive the compressor;

passing exhaust gases from the turbine through a recuperator and passing the air-fuel mixture through the recuperator to pre-heat the mixture by heat exchange with the exhaust gases;

directing a portion of exhaust gases from the turbine into the compressor to raise an inlet temperature to the combustor; and wherein during part-load and near full-load operation of the gas turbine engine the fuel is passed through the compressor along with the air and the portion of exhaust gases, and a flow rate of the exhaust gas is variably adjusted using a controllable valve.

12. The method of claim 11, wherein mixing of the exhaust gases with the fuel is accomplished upstream of the compressor.

13. The method of claim 12, wherein the mixed exhaust gases and fuel are directed into the compressor separately from the air.

14. The method of claim 11, wherein at least some mixing of the fuel with the air is accomplished upstream of the compressor.

15. The method of claim 14, wherein the mixed fuel and air are directed into the compressor separately from the exhaust gases.

16. The method of claim 11, wherein the air, fuel, and exhaust gases are directed into the compressor separately from one another and mixing takes place in the compressor.

17. The method of claim 11, further comprising the step of controlling a flow rate of the exhaust gases directed into the compressor.

18. The method of claim 17, wherein the controlling step comprises controlling the flow rate in response to a parameter associated with the engine.

19. The method of claim 18, wherein the controlling step comprises controlling the flow rate to compensate for changes in ambient temperature.

20. The method of claim 19, wherein a relative portion of the exhaust gases directed into the compressor is increased when there is a decrease in ambient temperature.

21. The method of claim 18, wherein the controlling step comprises controlling the flow rate to compensate for changes in relative engine load.

22. The method of claim 21, wherein a relative proportion of the exhaust gases directed into the compressor is increased when there is a decrease in relative engine load.

23. The method of claim 11, wherein the portion of exhaust gases directed into the compressor is separated from the remainder of the exhaust gases at a point downstream of the recuperator.

24. The method of claim 11, wherein the portion of exhaust gases directed into the compressor is separated from the remainder of the exhaust gases at a point upstream of the recuperator such that said portion bypasses the recuperator.

25. The method of claim 11, further comprising the step of driving an electrical generator with the turbine.

26. A method for operating a gas turbine engine, comprising the steps of:

compressing air in a compressor;

mixing fuel with compressed air from the compressor to produce an air-fuel mixture;

burning the air-fuel mixture in a catalytic combustor to produce hot combustion gases;

expanding the combustion gases in a turbine to produce mechanical power, and using the mechanical power to drive the compressor;

passing exhaust gases from the turbine through a recuperator and passing the air-fuel mixture through the recuperator to pre-heat the mixture by heat exchange with the exhaust gases;

directing a portion of exhaust gases from the turbine into the compressor to raise an inlet temperature to the combustor; and controlling a flow rate of the exhaust gases directed into the compressor during part-load and near full-load operation of the gas turbine engine in response to a measured combustor inlet temperature.

27. The method of claim 26, wherein the flow rate is controlled so as to always maintain the combustor inlet temperature higher than a predetermined minimum temperature necessary for proper operation of the catalytic combustor.

28. The method of claim 27, further comprising the step of deducing fuel/air ratio of the mixture entering the combustor, and controlling the combustor inlet temperature so as to optimize the combustor inlet temperature for said fuel/air ratio in such a manner that at all times a maximum allowable recuperator temperature is not exceeded.

29. The method of claim 27, further comprising the step of deducing fuel/air ratio of the mixture entering the combustor, and controlling the combustor inlet temperature so as to optimize the combustor inlet temperature for said fuel/air ratio in such a manner that a maximum allowable emissions limit is not exceeded.

30. The method of claim 29, further comprising the step of deducing fuel/air ratio of the mixture entering the combustor, and controlling the combustor inlet temperature so as to optimize the combustor inlet temperature for said fuel/air ratio in such a manner that an efficiency of the engine is maximized.

31. The method of claim 27, further comprising the step of deducing fuel/air ratio of the mixture entering the combustor, and controlling the combustor inlet temperature so as to optimize the combustor inlet temperature for said fuel/air ratio in such a manner that emissions are minimized.

32. The method of claim 31, further comprising the step of deducing fuel/air ratio of the mixture entering the combustor, and controlling the combustor inlet temperature so as to optimize the combustor inlet temperature for said fuel/air ratio in such a manner that efficiency is maximized.

* * * * *